US010507482B2

(12) United States Patent
Jung et al.

(10) Patent No.: US 10,507,482 B2
(45) Date of Patent: Dec. 17, 2019

(54) CONTAINER FOR DISCHARGING POWDER

(71) Applicant: YONWOO CO., LTD., Incheon (KR)

(72) Inventors: Seo-Hui Jung, Incheon (KR); Ki-Young Ham, Incheon (KR)

(73) Assignee: YONWOO CO., LTD., Incheon (KR)

( * ) Notice: Subject to any disclaimer, the term of this patent is extended or adjusted under 35 U.S.C. 154(b) by 153 days.

(21) Appl. No.: 15/324,163

(22) PCT Filed: Sep. 22, 2016

(86) PCT No.: PCT/KR2016/010576

§ 371 (c)(1),
(2) Date: Jan. 5, 2017

(87) PCT Pub. No.: WO2017/188521

PCT Pub. Date: Nov. 2, 2017

(65) Prior Publication Data

US 2018/0178232 A1 Jun. 28, 2018

(30) Foreign Application Priority Data

Apr. 26, 2016 (KR) ..... 10-2016-0050865

(51) Int. Cl.

| | |
|---|---|
| ***B05B 11/06*** | (2006.01) |
| ***B05B 11/00*** | (2006.01) |
| ***B65D 83/06*** | (2006.01) |
| ***A45D 33/02*** | (2006.01) |
| ***A45D 33/08*** | (2006.01) |

(52) U.S. Cl.
CPC ..... *B05B 11/062* (2013.01); *A45D 33/02* (2013.01); *A45D 33/08* (2013.01);
(Continued)

(58) Field of Classification Search
CPC ..... B65D 83/06; A45D 33/02; A45D 33/08; B05B 11/062; B05B 11/3059
(Continued)

(56) References Cited

U.S. PATENT DOCUMENTS 4,157,789 A * 6/1979 Laauwe ..... B05B 7/0416 222/211
5,082,148 A * 1/1992 Dunning ..... B65D 83/06 128/203.15

(Continued)

FOREIGN PATENT DOCUMENTS

KR 10-1378719 B1 3/2014
KR 2015-0077490 A 7/2015

*Primary Examiner* — Paul R Durand
*Assistant Examiner* — Andrew P Bainbridge
(74) *Attorney, Agent, or Firm* — Marshall, Gerstein & Borun LLP

(57) ABSTRACT

The present invention disclosed herein relates to a container for discharging powder, in particular, a container for discharging powder having a structure wherein a discharging hole of a button part and a connecting hole of a stem are connected or dislocated according to rotation directions, and an opening/closing member is inserted into the stem inside the button part and ascends/descends according to a rotation of the button part, and thereby opens/closes a movement hole of the stem, such that it will solve inconvenience problems such as attaching/detaching the opening/closing member whenever using as well as prevent a risk of losing the opening/closing member, thereby providing user convenience.

11 Claims, 5 Drawing Sheets

(52) U.S. Cl.
CPC ..... *B05B 11/0029* (2013.01); *B05B 11/0032* (2013.01); *B05B 11/3059* (2013.01); *B65D 83/06* (2013.01)

(58) Field of Classification Search
USPC ..... 222/153.12–153.14, 153.04, 630–633, 222/321.7–321.8, 380, 383.1, 383.3, 384, 222/464.1–464.7
See application file for complete search history.

(56) References Cited

U.S. PATENT DOCUMENTS 5,203,841 A * 4/1993 Kitabayashi ..... B65D 47/2043 222/402.11
5,228,598 A * 7/1993 Bally ..... B67D 7/74 222/129.2
5,323,936 A * 6/1994 Wolter ..... A61M 13/00 128/200.22
5,388,730 A * 2/1995 Abbott ..... B65D 83/205 222/153.13
7,178,694 B2 * 2/2007 Costa ..... B05B 11/0027 222/153.13
7,434,707 B2 * 10/2008 Meshberg ..... B05B 11/3059 215/216
7,775,737 B2 * 8/2010 Deans ..... A45D 33/02 401/117
7,841,494 B2 * 11/2010 Batinkoff ..... B05B 11/062 222/207
7,891,525 B2 * 2/2011 Behar ..... B05B 11/3059 222/153.11
9,393,583 B2 * 7/2016 Tu ..... B05B 1/267

* cited by examiner

[Fig. 1]
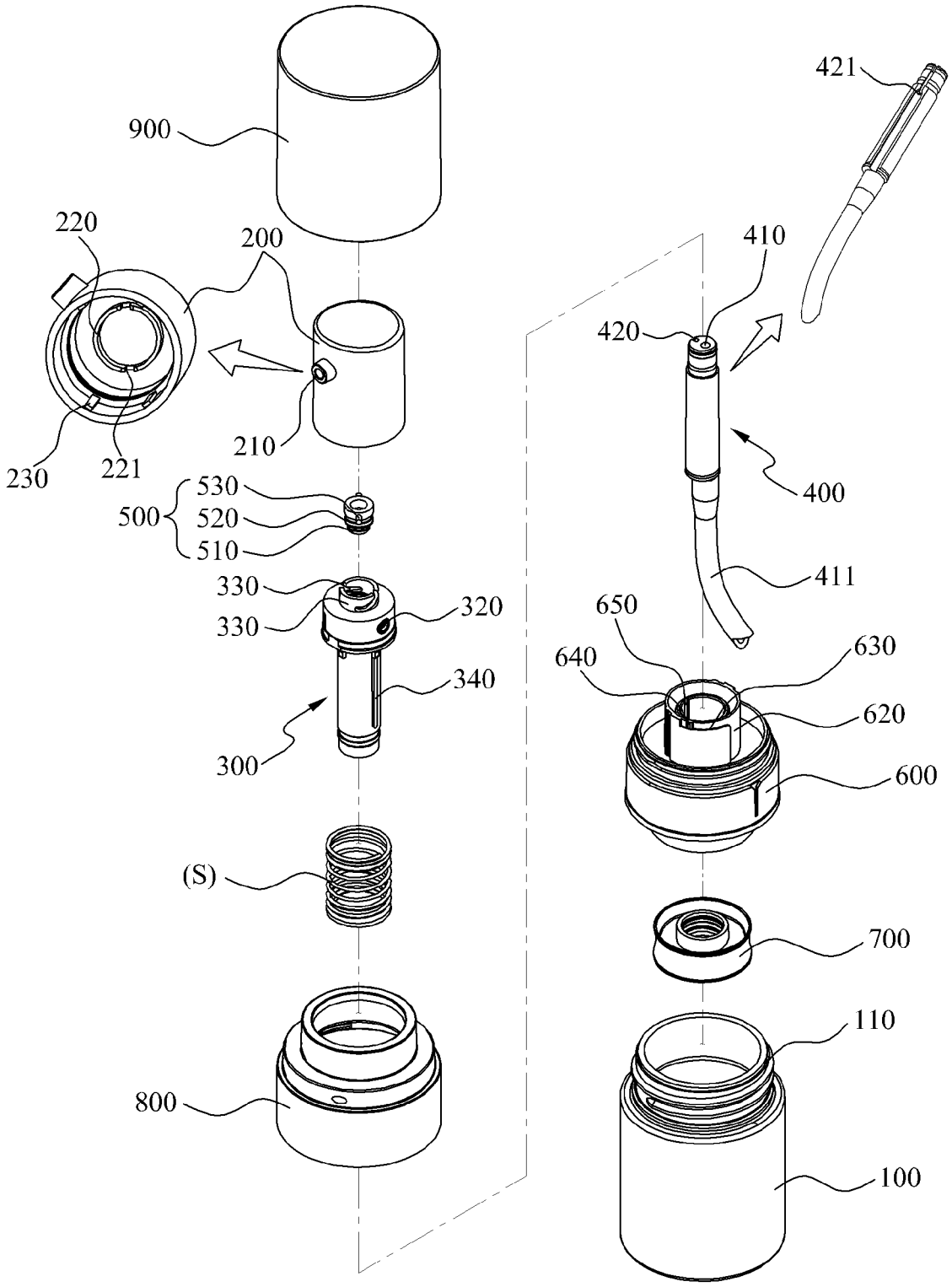

[Fig. 2]
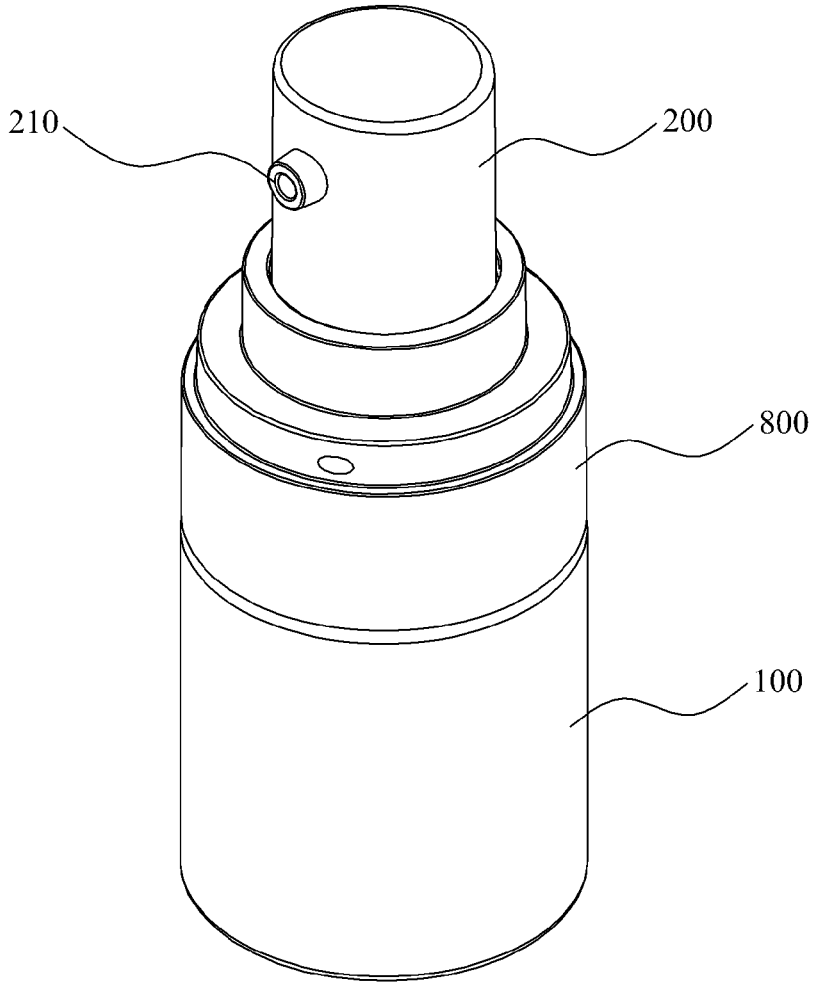

[Fig. 3]
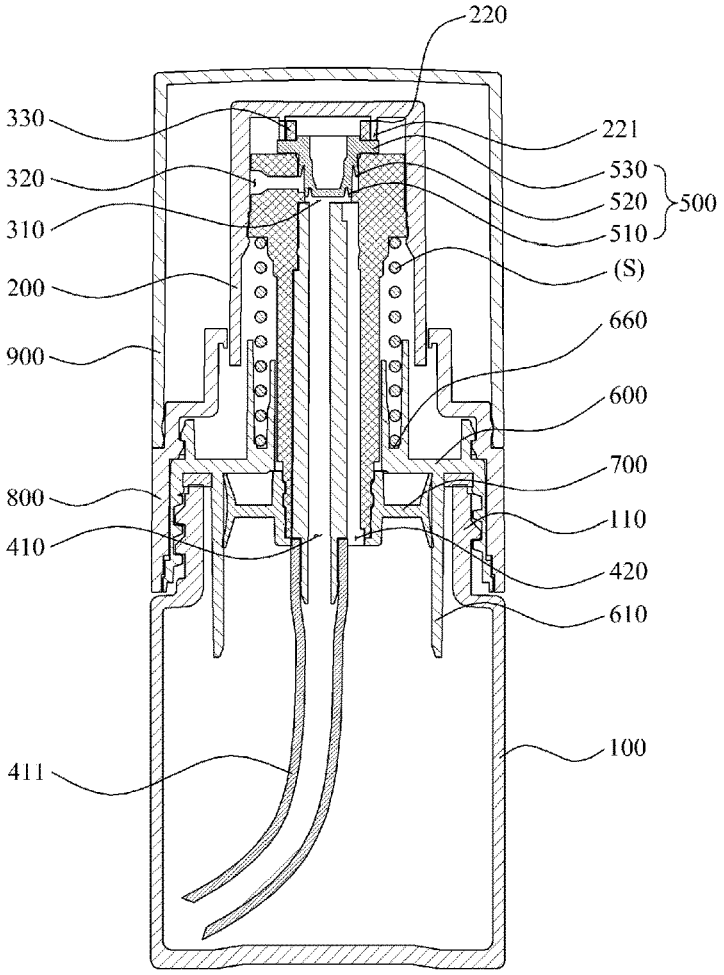
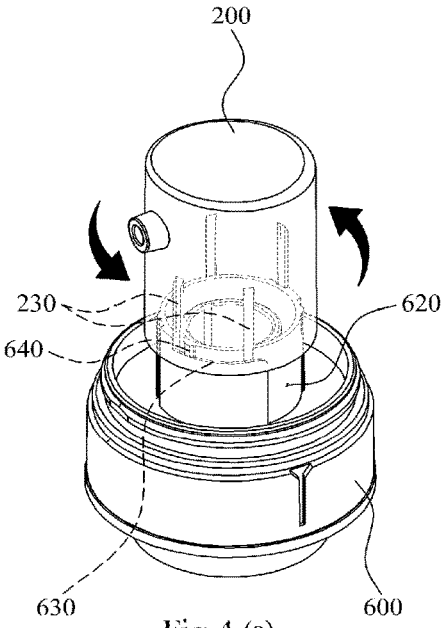
Fig.4 (a)
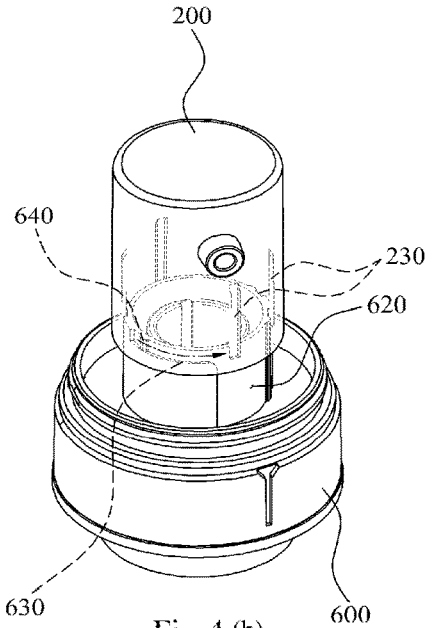
Fig.4 (b)

[Fig. 5]
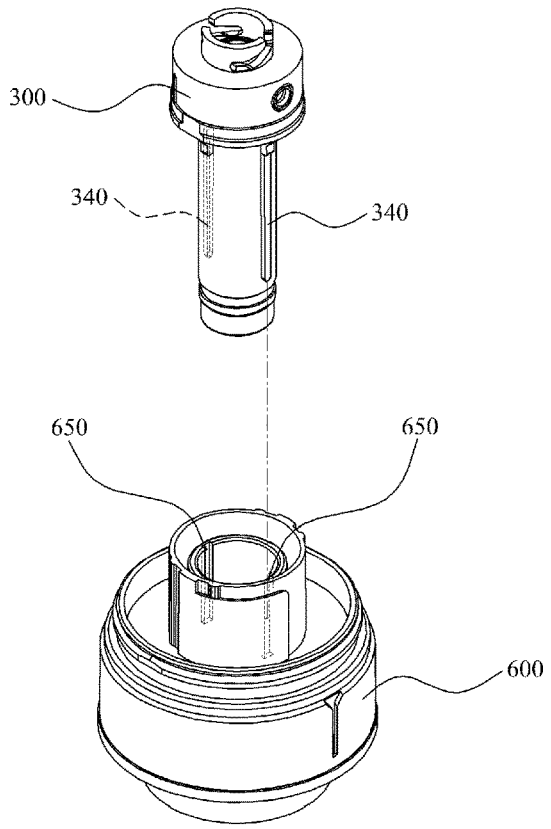
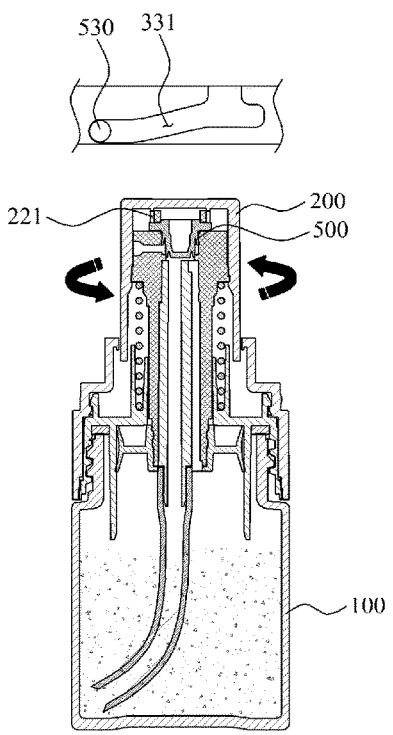
Fig. 6 (a)
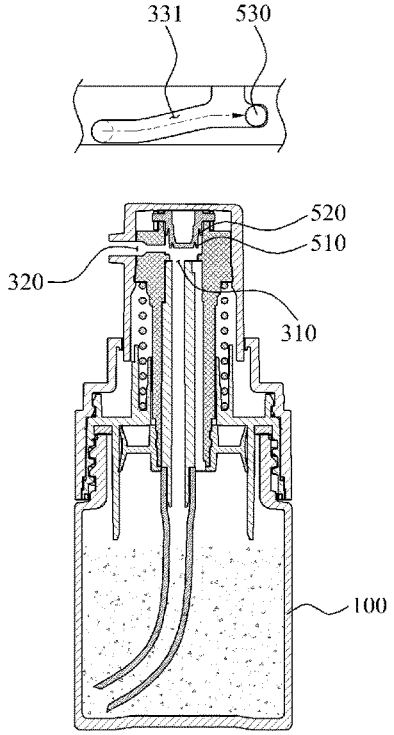
Fig. 6 (b)

CONTAINER FOR DISCHARGING POWDER

TECHNICAL FIELD

The present disclosure relates to a container for discharging powder, in particular, a container for discharging powder having a structure wherein a discharging hole of a button part and a connecting hole of a stem are connected or dislocated according to rotation directions, and an opening/closing member is inserted into the stem inside the button part and ascends/descends according to a rotation of the button part, thereby opening/closing a movement hole of the stem, such that it will solve inconvenience problems such as having to attach/detach the opening/closing member whenever using as well as prevent a risk of losing the opening/closing member, thereby providing user convenience.

BACKGROUND

Generally, power has its good wearability when applied on skin, and has its high water-repellency, such that power is widely being used because a user feels fresh on the skin and gets her makeup to look natural.

When applying a power-type makeup, a user usually applies power contained in a container body of a powder container, smearing powder with a puff that is separately equipped. This type of power container is disclosed in Korean Registered Patent No. 10-1171305. (Hereafter, referred as 'the registered patent')

The above registered patent is to provide a space wherein powder is filled therein, comprising a container body (10) having an upper surface opened and a bottom surface with an air inlet hole (10*h*); a pumping means (30) having a diaphragm (31), which is a contractible element made of elastic material with a cylindrical shape such that a rim of a lower portion can be folded into a rim of a bottom surface of the container body (10), absorbing air from the outside by a pumping operation and discharging the air into the space wherein the powder is filled outwardly through an air discharging hole (31*h*) formed at a center thereof, and an opening/closing button (35) which is disposed at an upper center portion of the diaphragm (31) and controls opening/closing of the air discharging hole (31*h*); a fixing plate (40) configured to be able to ascend/descend but not to be rotated in a state that an outer circumferential surface is closely contacted to an inner wall at an upper side of the pumping means (30), comprising a multitude of lower part holes (40*h*) wherein powder particles pass through; an operational plate (50) equipped to be able to make a restricted rotation to the fixing plate (40), comprising a lower part hole (40*h*) and an upper part hole (50*h*) so as to control an opening/closing of the lower part hole (40*h*); a cap (20) tightened with a screw so as to cover an opened upper surface of the container body (10), and configured for an inner side surface to have a friction contact with an outer side surface of an operational plate (50), thereby connecting the operational plate and rotating when assembled with the container body (10).

The registered patent above has a configuration that powder comes to be discharged and to be applied on the puff (60) when an operation plate is tapped lightly with a puff (60) or pressurized in a state of a cap (20) being opened. However, a user should hold the puff (60) with one hand and then pressurize an operational plate (50) while holding the container body (10) with the other hand, thereby resulting in user inconvenience.

To solve the problems above, the applicant of the present invention discloses "A container for discharging powder" in a registered patent number 10-1378719 (hereafter called as the patent document 2), which was registered on Mar. 21, 2014 after being filed on Jan. 24, 2014.

The patent document 2 includes: a container body where powder is stored; a button part which is disposed at an upper portion of the container body and ascends/descends according to a user's pressurization, comprising, at one side thereof, a discharging hole such that the power can be discharged; and a stem which is coupled to a lower portion of the button part and moves along according to the movement of the button part, comprising a powder moving passage where powder moves and an air moving passage where air moves, separately installed at an inner side thereof. It is characterized with a structure wherein an inner pressure of the container body is changed according to pressurization of the button part, and powder and air move into an interior of the stem respectively through the powder moving passage and the air moving passage, such that the powder is sprayed through the discharging hole by the pressure of the air.

The patent document 2 discloses a structure wherein powder is easily sprayed onto a user's skin to be used when the button part is pressed. However, since an opening/closing member which opens/closes the discharging hole is configured to have to be attached/detached to the button part, there arises not only a risk of losing the opening/closing member but also a problem that the power may be leaked through the discharging hole in case the container is shaken or dropped in a state of the discharging hole not being closed by the opening/closing member.

Furthermore, there is another problem that the opening/closing member should be detached from the button part before using and be coupled to the button part after using, thus leading to user inconvenience.

SUMMARY OF THE DISCLOSURE

The presently described embodiments are devised to solve such problems described in the above, and the objective thereof is to provide a container for discharging powder having a structure wherein a discharging hole of a button part and a connecting hole of a stem are connected or dislocated according to rotation directions, and an opening/closing member is inserted into the stem inside the button part and ascends/descends according to rotation of the button part, and thereby opens/closes a movement hole of the stem, such that it will solve inconvenience problems such as attaching/detaching the opening/closing member whenever using and prevent a risk of losing the opening/closing member, thereby providing user convenience.

To solve problems above, a container for discharging powder, according to first embodiments, is characterized to include: a container body storing powder therein; a button part rotatably disposed at an upper portion of the container body, ascending/descending according to the presence or absence of a user's pressurizing, and comprising a discharging hole at one side thereof; a stem disposed at an inner side of the button part and ascending/descending along with the button part, further comprising a movement hole at an upper portion thereof such that powder can move by control of the button part, and a connecting hole at a side thereof which is connected with the discharging hole such that the powder moving through the movement hole can be discharged through the discharging hole; a content movement part coupled at an inner side of the stem, separately comprising a powder moving passage where powder moves and an air moving passage where air moves; and an opening/closing member inserted to an upper portion of the stem, opening the movement hole as ascending when the button part rotates to one side direction and closing the movement hole as descending when the button part rotates to the other direction, wherein the inner pressure of the container body changes according to the pressurization of the button part, and powder and air move into an interior of the content movement part respectively through the powder moving passage and the air moving passage, and then the powder is sprayed through the discharging hole by air pressure.

Furthermore, the container is characterized to further include a support body which is coupled to an upper portion of the container body, forming an extension part which extends to a lower part thereof so as to encase an upper inner circumferential surface of the container body at an upper inner side thereof.

Furthermore, the container is characterized to further include a piston, at a lower portion of the stem, which moves along according to the ascent/descent of the stem, and gets closely contacted to inner circumferential surface of the extension part so as to change an inner pressure of the container body.

Furthermore, the container is characterized to further include a protrusion part which is formed at a lower end of the stem, and comprises a spiral guide groove at both sides of an outer circumferential thereof so as to guide the ascent/descent of the ascending/descending member.

Furthermore, the container is characterized to further include a guide tube which guides the ascent/descent of the ascending/descending member at an inner upper side of the button part, and a vertical guide groove which guides the vertical movement of the ascending/descending member at both sides of the guide tube.

Furthermore, the ascending/descending member includes a first sealing part which is contacted to an inner circumferential surface of the stem to close the movement hole in a state of the ascending/descending member being lowered, and is separated from the inner circumferential surface to open the movement hole in a state of the ascending/descending member being raised up;

a second sealing part which is closely contacted to an upper inner circumferential surface of the stem so that powder, which is supposed to move through the movement hole, is prevented from moving to an upper part of the stem not to the connecting hole and thus from being leaked; and a guide protrusion which is inserted to the vertical guide groove and the spiral guide groove, moving along the vertical guide groove and the spiral guide groove and guiding the ascent/descent of the ascending/descending member.

Furthermore, the container is characterized to further include a rotation preventing protrusion, which is longitudinally formed so that the stem can be prevented from being rotated when the button part rotates, at an outer circumferential surface of the stem, and a rotation preventing groove, where the rotation preventing protrusion is inserted, at an inner circumferential surface of the support body.

Furthermore, the container is characterized in that a pumping guide groove, which forms a space so that the button part can be able to ascend/descend, is equipped at both sides of an upper outer circumferential surface, and a pumping preventing protrusion which prevents the button part from moving downwards.

Furthermore, the container is characterized in that a pumping guide protrusion, installed at an inner circumferential surface, is placed directly above the pumping guide groove and ascends/descends along the pumping guide groove when the button part rotates to one side direction. The pumping guide protrusion is placed directly above the pumping preventing protrusion and prevents the button part from descending when the button part rotates to the other side direction.

Furthermore, the container is characterized in that an air compressing hole having a smaller diameter than that of the air moving passage is installed at an end of the air moving passage of the content movement part so as to compress and spray air therein.

Furthermore, the container is characterized in that at a lower portion of the powder moving passage is installed a powder absorbing tube which moves the powder stored in the container body to the powder movement tube, wherein the powder absorbing tube moves upwards/downwards according to the pressurization of the button part and stirs the powder stored in the container body.

As described as the above, a container for discharging powder is configured in a way that a discharging hole of a button part and a connecting hole of a stem are connected or dislocated according to rotation directions, and an opening/closing member inserted into the stem inside the button part ascends/descends according to a rotation of the button part and thereby opens/closes a movement hole of the stem, such that it will solve inconvenience problems such as attaching/detaching the opening/closing member whenever using as well as preventing a risk of losing the opening/closing member, thereby providing user convenience.

BRIEF DESCRIPTION OF THE DRAWINGS

FIG. 1 is an exploded perspective view illustrating a configuration of a container for discharging powder according to an exemplary embodiment.

FIG. 2 is a combined perspective view illustrating a configuration of the container for discharging powder according to an exemplary embodiment.

FIG. 3 is a combined cross-sectional view illustrating a configuration of the container for discharging powder according to an exemplary embodiment.

FIG. 4(*a*) to FIG. 4(*b*) is an explanatory drawing illustrating a position of a pumping guide protrusion depending on the rotation of a button part of the container for discharging powder according to an exemplary embodiment.

FIG. 5 is an explanatory drawing illustrating coupling state of a rotation preventing protrusion of a stem and a rotation preventing groove of a support body of the container for discharging powder according to an exemplary embodiment.

FIG. 6(*a*) through FIG. 8(*f*) are state diagrams illustrating an operational state of the container for discharging powder according to an exemplary embodiment.

DETAILED DESCRIPTION

Figure 7:
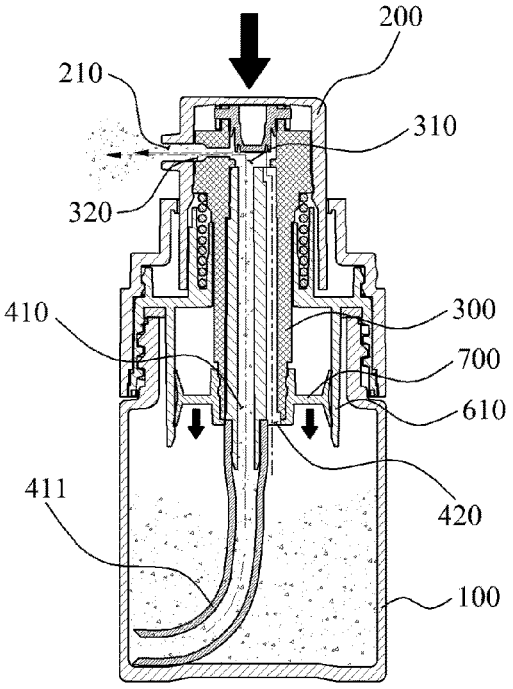
Figure 7:
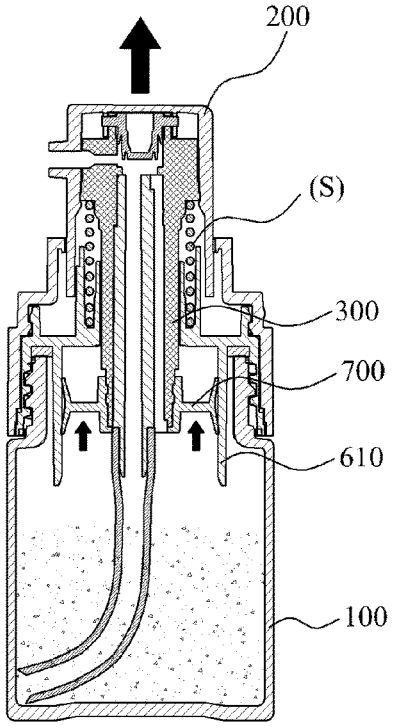

Hereinafter, exemplary embodiments will be described in detail with reference to the accompanying drawings. The same reference numerals provided in the drawings indicate the same members.

FIG. 1 is an exploded perspective view illustrating a configuration of a container for discharging powder according to an exemplary embodiment. FIG. 2 is a combined perspective view illustrating a configuration of the container for discharging powder according to an exemplary embodiment. FIG. 3 is a combined cross-sectional view illustrating a configuration of the container for discharging powder according to an exemplary embodiment.

FIG. 4(*a*) to FIG. 4(*b*) is an explanatory drawing illustrating a position of a pumping guide protrusion depending on the rotation of a button part of the container for discharging powder according to an exemplary embodiment. FIG. 5 is an explanatory drawing illustrating coupling state of a rotation preventing protrusion of a stem and a rotation preventing groove of a support body of the container for discharging powder according to an exemplary embodiment.

Referring to FIGS. 1 to 5, the container for discharging powder according to an exemplary embodiment includes a container body 100, a button part 200, a stem 300, a content movement part 400 and an opening/closing member 500.

The container body 100 containing powder comprises a discharging outlet 110 at an upper portion thereof such that the powder contained therein can be discharged.

At an upper portion of the container body 100 is coupled a support body 600 which is coupled to the discharging outlet 110 and closes an upper end of the discharging outlet 110. At an inner upper side of the support body 600 is equipped an extension part 610 which extends to a lower portion thereof so as to encase an upper inner circumferential surface of the container body 100, wherein at an inner side of the extending part 610 is equipped a piston 700 which ascends/descends in a state of being tightly contacted to an inner circumferential surface of the extending part 610 and thereby changes the inner pressure of the container body 100.

Meanwhile, at both sides of an upper portion of the container body 100 is coupled a pumping guide groove 620 which forms a space such that a button part 200 can ascends/descends and a pumping preventing protrusion 620 which prevents a downward movement of the button part 200. It is preferred to install a fixing protrusion 640, at the pumping guide groove 620 and the pumping preventing protrusion 630, which fixes a pumping guide protrusion 230 of the button part 200, so as to prevent the button part 200 from randomly rotating in a state that the button part 200 completes its rotation either to one side direction or to the other direction.

Meanwhile, at an inner circumferential surface is formed a rotation preventing groove 650 where a rotation preventing protrusion 340 of the stem 300 so as to prevent the stem 300 from rotating along by the rotation of the button part 200.

Furthermore, at an upper portion of the support body 600 is installed a spring support part 660 so as to support a spring (S) which restores the button part 200 by providing an elastic force to the stem 300.

Meanwhile, a shoulder part 800 is coupled at an upper portion of the container body 100, encasing the support body 600, wherein the shoulder part 800 forms a space where a button part to be described later is inserted to ascend/descend, and an over cap 900 is coupled at an outer side of the shoulder part 800, encasing the button part 200, to prevent a malfunction of the button part 200.

The button part 200, which is rotatably coupled to a stem 300 at an upper portion of the container body 100, ascends/descends according to a user's pressurization and delivers the pressure to the stem 300, comprising a discharging hole 210 at one side thereof such that powder can be discharged.

At an inner upper side of the button part 200 is installed a guide tube 220 which guides the ascent/descent of an ascending/descending member 500, wherein at both sides of the guide tube 220 is formed a vertical guide groove 221 where a guide protrusion 530 of the ascending/descending member 500 is inserted to guide the vertical movement of the opening/closing member 500.

Furthermore, at an inner circumferential surface of the button part 200 is installed a pumping guide protrusion 230 which controls the ascending/descending movement of the button part 200, wherein the pumping guide protrusion 230 is placed directly above the pumping preventing protrusion 630 of the support body 600 normally when in in use, and prevents the button part 200 from descending. Meanwhile, when the button part 200 rotates to one side direction for using, the pumping guide protrusion 230 gets out of the pumping preventing protrusion 630, then is placed directly above the pumping guide groove 620, and moves along the pumping guide grooves 620, thereby enabling the button part 200 to ascend/descend.

At a lower portion of the button part 200 is installed a spring (S) which provides elastic force to an upward direction when a user releases pressurizing the button part 200. The spring is installed between a stem 300 to be described later and a spring support part 660 of the support body 600, and provides an elastic force to the stem 300, thereby enabling the button part 200 to be restored.

The stem 300 is coupled to a lower portion of the button part 200 and moves along as the button part 200 moves, wherein a movement hole 310 is formed at an inner side thereof such that powder can move toward a discharging hole 210 by controlling the button part 200, and at a side thereof is formed a connecting hole 320 which is connected with the discharging hole 210 such that the powder moving through the movement hole 310 can be discharged through the discharging hole 210.

At a lower portion of the stem 300 is coupled a piston 700 which is closely contacted to an inner circumferential surface of the extension part 610 so as to change an inner pressure of the container body 100 as moving along with the ascent/descent of the stem 300. The piston 700 ascends/descends in a state of being closely contacted to an inner circumferential surface of the extension part 610 according to whether or not the piston 700 pressurizes the button part 200, and thus changes an inner pressure of the container body 100, such that powder and air move to an upper portion through a powder movement passage 410 of the content movement part 400 and an air movement passage, and thereby are discharged through the discharging hole 210 of the button part 200.

Meanwhile, at an upper end of the stem 300 is installed a protrusion part 330 which has a spiral guide groove 331 formed at both sides of an outer circumferential surface thereof so as to guide the ascent/descent of the opening/closing member 500, wherein a guide protrusion 530 of the opening/closing member 500 moves along the spiral guide groove 331 when the button part 200 rotates to one side direction or to the other direction, thereby leading to ascending/descending of the opening/closing member 500.

Furthermore, at an outer circumferential surface of the stem 300 is formed a rotation preventing protrusion 340 which is inserted into a rotation preventing groove 650 of the support body 600 in order to prevent the stem 300 from rotating when the button part 200 rotates.

The content movement tube 400 is coupled to an inner side of the stem 300 and forms a space where powder and air move. A powder moving passage 410 where powder moves and an air moving passage 420 where air moves are separately formed at an inner side of the content movement part 400.

Upper ends of the powder moving passage 410 and the air moving passage 420 are connected with the movement hole 310 of the stem 300 such that the powder and air moving respectively through the powder moving passage 410 and the air moving passage 420 can move to the discharging hole 210 via the stem 300.

At an end of the air moving passage 420 is formed an air compressing hole 421 which has a smaller diameter than that of the air moving passage 420, wherein the air moving through the air moving passage 420 is compressed and is sprayed as passing through the air compressing hole 421, such that the powder moving through the powder moving passage 410 can be sprayed through the discharging hole 210.

Furthermore, at a lower portion of the powder moving passage 410 is coupled a powder absorbing tube 411 for moving the powder stored in the container body 100 to the powder moving passage 410, wherein the powder absorbing tube 411 moves upwards/downwards along with the stem 300 when the stem 300 ascends/descends according to pressurization of the button part 200, and moves the powder as stirring the powder stored in the container body 100.

The powder absorbing tube 411 is preferred to be made of soft flexible material not to interfere with a bottom surface of the container body 100 in a process of moving upward/downward.

The opening/closing member 500 comprises a first sealing part 510, a second sealing part 520, and a guide protrusion 530, such that the opening/closing member 500 can be inserted to an upper portion of the stem 300, ascend to open the movement hole 310 when the button part 200 rotates to one side direction, and descend to close the movement hole 310 when the button part 200 rotates to the other side direction.

The first sealing part 510 opens/closes the movement hole 310 as being closely contacted to or separated from an inner circumferential surface of the stem 300 according to the ascent/descent of the opening/closing member 500, wherein the first sealing part 510 is closely contacted to an inner circumferential surface of the stem 300 and closes the movement hole 310 in a state that the opening/closing member 500 is lowered, whereas the first sealing part 510 is detached from the inner circumferential surface of the stem 300 and opens the movement hole 310 in a state that the opening/closing member 500 is raised up.

The second sealing part 520, disposed at an upper portion of the first sealing part 510 and ascending/descending in a state of being closely contacted to an upper inner circumferential surface of the stem 300, closes an inner upper space of the stem 300 disposed higher than the connecting hole 320, such that the powder and air moving through the movement hole 310 is prevented from moving to an upper portion of the stem 300 and thus from being leaked.

The guide protrusion 530, a pair of which are protrusively formed at both sides of an outer circumferential surface of the opening/closing member 500 and ascend/descend the opening/closing member 500 either by one side rotation or by the other side rotation, is inserted into the vertical guide groove 221 and the spiral guide groove 331 and moves along the vertical guide groove 221 and the spiral guide groove 331 by the rotation of the button part 200, thereby guiding the opening/closing member 500 to ascend/descend.

Hereinafter, with reference to FIG. 6(*a*) through FIG. 8(*f*), a powder-discharging process of a container for discharging powder according to an exemplary embodiment will be described. FIG. 6(*a*) through FIG. 8(*f*) are views illustrating an operational state of a container for discharging powder according to an exemplary embodiment.

First, referring to FIG. 4(*a*) to FIG. 4(*b*), when the button part 200 rotates to one side direction in a state that the opening/closing member 500 is lowered, the guide protrusion 530 of the opening/closing member 500 ascends along the vertical guide groove 221 and the spiral guide groove 331 while the opening/closing member 500 is ascending. Due to this, the first sealing part 510 of the opening/closing member 500, closely contacted to an inner circumferential surface of the stem 300, gets separated from the inner circumferential surface of the stem 300, thus opening the movement hole 310.

As the above, when the movement hole 310 opens, a connecting hole 320 and a discharging hole 210 get connected. Under this state as illustrated in FIG. 7(*c*) to FIG. 7(*d*), when the button part 200 is pressurized, the stem 300 coupled at a lower portion of the button part 200 descends. At this time, a piston 700 coupled to a lower portion of the stem 300 descends in a state of being closely contacted to an inner circumferential surface of the extension part 610, thus changing an inner pressure of the container body 100.

When the inner pressure of the container body 100 is changed through the process in the above, powder is absorbed through the power absorbing tube 411 in a process that the air stored in the container body 100 is discharged to the discharging hole 210 through the air moving passage 420, and then moves to the powder moving passage 410. At this time, the air moving through the air moving passage 420 compresses the air as passing through the air compressing hole 421, and then sprays the air, such that it is possible to spray the powder moving through the powder moving passage 410 through the discharging hole 210.

Figure 8:
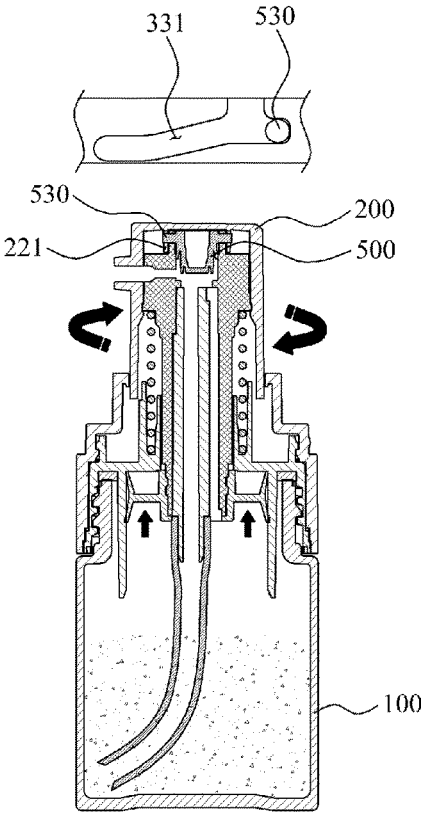
Figure 8:
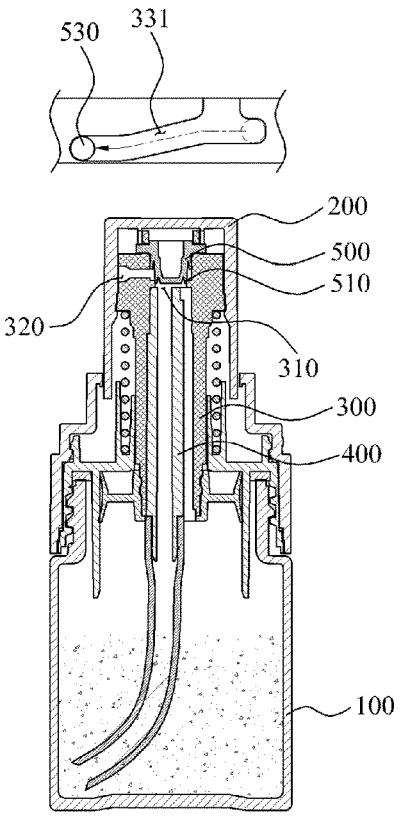

Meanwhile, as illustrated in FIG. 8(*e*) to FIG. 8(*f*), when the button part 200 rotates to the other side direction in a state that the opening/closing member 500 is raised up, the guide protrusion 530 of the opening/closing member 500 descends along the vertical guide groove 221 and the spiral guide groove 331, thereby leading the opening/closing member 500 to descend. Due to this, the first sealing part 510 of the opening/closing member 500 gets closely contacted to an inner circumferential surface of the stem 300, thereby closing the movement hole 310.

As the above, when the movement hole 310 is closed by the first sealing part 510, the powder moving through the content movement part 400 is not possible to move to an upper portion; therefore, powder can be prevented from being leaked through the discharging hole 210 no matter whether the container is dropped or shaken. In a state that the movement hole 310 is closed by the first sealing part 510, the connecting hole 320 and the discharging hole 210 are configured to be dislocated.

The opening/closing member 500 is inserted to the stem 300 in an interior of the button part 200 and ascends/descends according to rotation of the button part 200, thereby opening/closing the movement hole 310. Therefore, there arises no risk of losing the opening/closing member 500, and the problem that a user has to attach or detach the opening/closing member 500 on every use will be solved as well, thereby providing user convenience.

As described above, optimal embodiments have been disclosed in the drawings and the specification. Although specific terms have been used herein, these are only intended to describe certain embodiments and are not intended to limit the meanings of the terms or to restrict the scope as recited by the accompanying claims. Therefore, those skilled in the art will appreciate that various modifications and other equivalent embodiments are possible from the above embodiments.

What is claimed is:

1. A container for discharging powder, comprising:

a container body storing powder;

a button part rotatably disposed at an upper portion of the container body and ascending/descending according to the presence or absence of a user's pressurizing, further comprising a discharging hole, where powder is discharged, at one side thereof;

a stem which is disposed at an inner side of the button part and moves along with the movement of the button part, comprising a movement hole at an upper portion thereof such that powder can flow according to the manipulation of the button part and further comprising, at a side thereof, a connecting hole connected with the discharging hole such that the powder flowing through the movement hole can be discharged through the discharging hole;

a content movement part which is disposed at an inner side of the stem, separately forming a powder moving passage where powder flows and an air moving passage where air flows; and an opening/closing member, which is inserted into an upper portion of the stem, ascending and opening the movement hole when the button part rotates to one side direction and closing the movement hole when the button part rotates to the other side direction, wherein the discharging hole of the button part and the connecting hole of the stem are connected to each other when the opening/closing member ascends by the rotation of the one side direction and opens the movement hole, the discharging hole of the button part and the connecting hole of the stem are disconnected from each other when the button part descends and closes the movement hole, wherein the container for discharging powder is characterized in a way that an inner pressure of the container body changes according to pressurization of the button part, and powder and air flow into the stem respectively through the powder passageway and the air passageway to the content movement part, thereby making powder discharged and sprayed through the discharging hole by air pressure.

2. The container for discharging powder of claim 1, wherein a support body coupled to an upper portion of the container body comprises an extension part which extends to a lower portion so as to encase an upper inner circumferential surface of the container body at an inner upper side thereof.

3. The container for discharging powder of claim 2, wherein a piston, closely contacted to an inner circumferential surface of the extension part so as to move along with ascent/descent of the stem and thereby changes an inner pressure of the container body, is coupled at a lower portion of the stem.

4. The container for discharging powder of claim 2, wherein a rotation preventing protrusion is provided longitudinally at an outer circumferential surface of the stem so as to prevent the stem from being rotated along when the button part rotates, and a rotation preventing groove is provided at an inner circumferential surface of the support body.

5. The container for discharging powder of claim 4, wherein a pumping guide groove, forming a space where the button part can ascend/descend, and a pumping preventing protrusion, preventing the button part from moving downwards, are provided at both sides of an outer circumferential surface of the stem.

6. The container for discharging powder of claim 5, wherein at an inner circumferential surface of the button part is provided a pumping guide protrusion, disposed directly above the pumping guide groove and moving along the pumping guide groove when the button part rotates to one side direction, and disposed directly above the pumping preventing protrusion and preventing the button part from descending when the button part rotates to the other side direction.

7. The container for discharging powder of claim 1, wherein a protrusion part forming a spiral guide groove at both sides of an outer circumferential surface thereof so as to guide the ascent/descent of the opening/closing member is provided at an upper end of the button part.

8. The container for discharging powder of claim 7, wherein a guide tube guiding the ascent/descent of the ascending/descending member is provided at an inner upper side of the button part, wherein a vertical guide groove guiding the vertical movement of the opening/closing member is provided at both sides of the guide tube.

9. The container for discharging powder of claim 8, wherein the opening/closing member comprising:

a first sealing part closing the movement hole by being closely contacted to an inner circumferential surface of the stem in a state of the opening/closing member being lowered, and opening the movement hole by being separated from an inner circumferential surface of the stem in a state of the opening/closing member being raised up;

a second sealing part closely contacted to an upper inner circumferential surface of the stem such that powder moving through the movement hole can move to an upper portion of the stem not to the connecting part, thereby being prevented from being leaked; and a guide protrusion inserted to the vertical guide groove and the spiral guide groove and guiding the ascent/descent of the opening/closing member as moving along the vertical guide groove and the spiral guide groove by rotation of the button part.

10. The container for discharging powder of claim 1, wherein at an end of an air moving passage is provided an air compressing hole whose diameter is smaller than that of an air moving passage such that it is possible to compress and spray air.

11. The container for discharging powder of claim 1, wherein at a lower portion of the powder moving passage is coupled a powder absorbing tube which moves the powder stored in the container body to the power moving passage, wherein the powder absorbing tube moves upwards/downwards according to the presence/absence of pressurization of the button part and stirs the powder stored in the container body.

* * * * *